US006076194A

United States Patent [19]

Purkett

[11] Patent Number: 6,076,194

[45] Date of Patent: Jun. 20, 2000

[54] WEARING APPAREL SYSTEM WITH SUSPENDED INDICIA

[76] Inventor: Varan C. Purkett, 328 W. 105th Pl., Chicago, Ill. 60628

[21] Appl. No.: 09/419,763

[22] Filed: Oct. 18, 1999

[51] Int. Cl.[7] ..... A41D 27/08; A41B 1/08

[52] U.S. Cl. ..... 2/279; 2/244

[58] Field of Search ..... 2/279, 244, 245, 2/249, 312, 314, 156, 160, 246, 300, 319, 115, 69, 67, 247; D11/80, 79, 97, 86, 13; D2/891, 895; 63/4, 40, 38, 21, 23

[56] References Cited

U.S. PATENT DOCUMENTS

| | | | |
|---|---|---|---|
| 1,446,179 | 2/1923 | Henkes | 63/23 |
| 2,336,398 | 12/1943 | Horowitz | 2/115 |
| 2,589,260 | 3/1952 | Jablon | 70/457 |
| 2,593,218 | 4/1952 | Swain | 2/48 |
| 2,677,901 | 5/1954 | Tilleman | 35/23 |
| 2,738,515 | 3/1956 | Owen | 2/279 |
| 3,414,945 | 12/1968 | Spalding | 24/90.5 |
| 3,701,166 | 10/1972 | Lindblom | 2/244 |
| 4,095,587 | 6/1978 | Ishikawa | 128/1.3 |
| 4,885,805 | 12/1989 | Mason | 2/244 |
| 5,016,284 | 5/1991 | Brown | 2/69 |
| 5,210,881 | 5/1993 | Stocker, Jr. et al. | 2/247 |
| 5,542,122 | 8/1996 | Moldovan | 2/69 |
| 5,617,587 | 4/1997 | Marchbanks | 2/247 |
| 5,791,076 | 8/1998 | Gailliard | 40/1.5 |

*Primary Examiner*—John J. Calvert
*Assistant Examiner*—Alissa L. Hoey

[57] ABSTRACT

A wearing apparel system including an item of wearing apparel has a torso portion with a pair of circular holes. The circular holes are laterally spaced along a horizontal line and have strengthening members around each hole. A flexible connector is formed of a plurality of hollow balls, including two end balls and a plurality of intermediate balls. Two small apertures extend through each ball in diametrically opposed relationship. A dumbbell shaped member is located between adjacent intermediate balls and between each end ball and its adjacent intermediate ball. The members include enlarged end sections located within adjacent balls and a reduced diameter central section extending through the apertures of adjacent balls. The connector also includes a coupling piece in a generally cylindrical configuration with spaced axial slits along one axial edge and an enlarged opening there between for the removable receipt of the end balls for allowing the connector to be selectively formed into a loop with the connector extending through the apertures with the coupling piece located interior of a portion of the wearing apparel. An object has means to couple the object to the connector at a location diametrically opposed to the coupling piece exteriorly of the apparel.

7 Claims, 4 Drawing Sheets

FIG 1
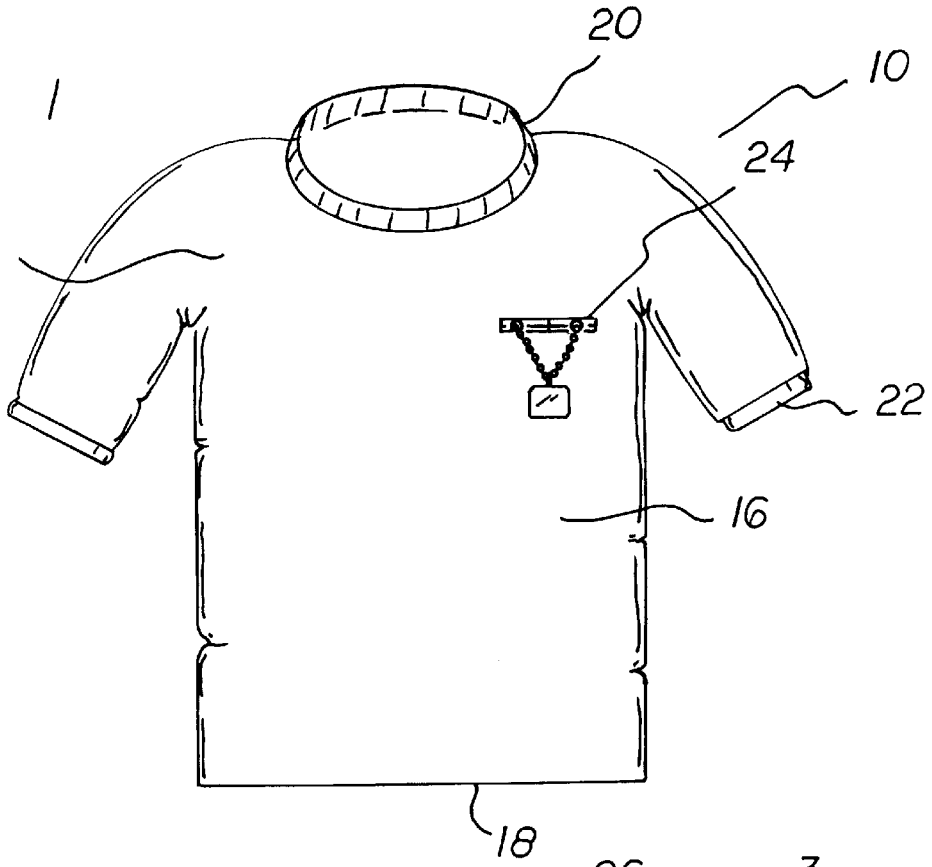
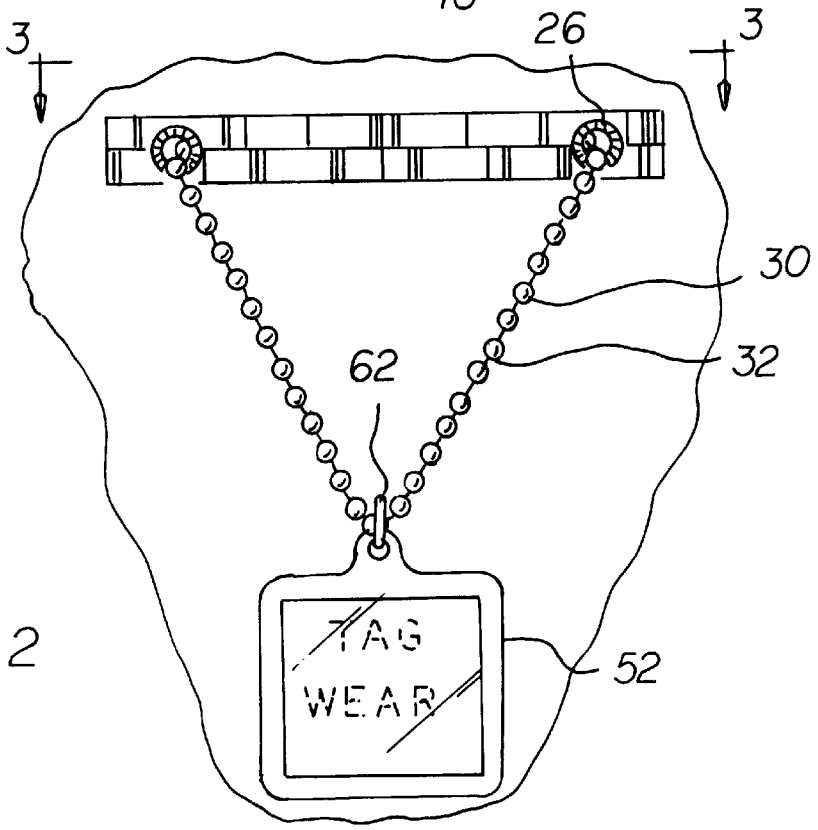
FIG 2

FIG 3
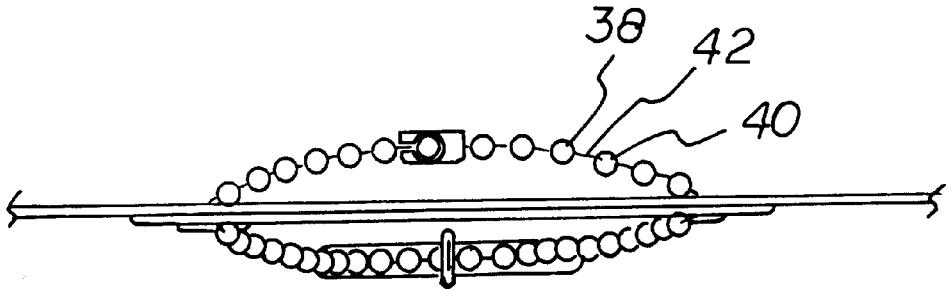
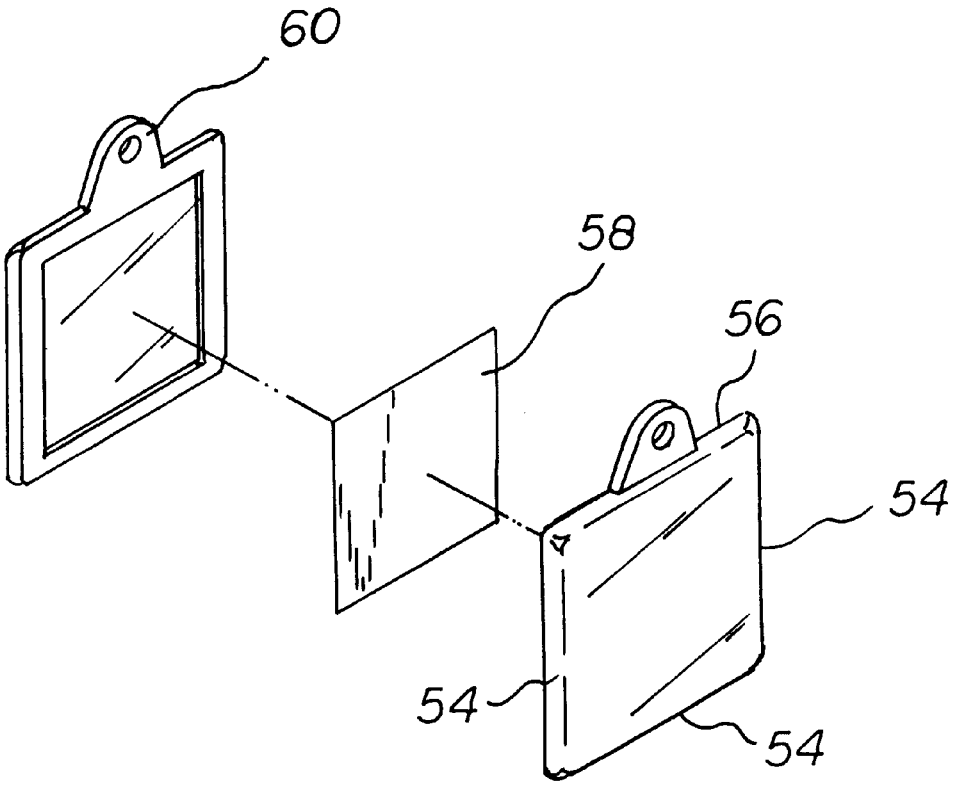
FIG 4

WEARING APPAREL SYSTEM WITH SUSPENDED INDICIA

BACKGROUND OF THE INVENTION

1. Field of the Invention

The present invention relates to a wearing apparel system with suspended indicia and more particularly pertains to suspending indicia of any one of a variety from an item of wearing apparel.

2. Description of the Prior Art

The use of wearing apparel, tags, indicia, etc. of known designs and configurations is known in the prior art. More specifically, wearing apparel, tags, indicia, etc. of known designs and configurations heretofore devised and utilized for the purpose of attaching indicia to apparel through known methods and apparatuses are known to consist basically of familiar, expected, and obvious structural configurations, notwithstanding the myriad of designs encompassed by the crowded prior art which has been developed for the fulfillment of countless objectives and requirements.

By way of example, U.S. Pat. No. 2,530,453 to M. Eagle discloses an apparel monogram attachment. U.S. Pat. No. 4,145,762 to Wallach discloses swim trunks with reversible pocket. U.S. Pat. No. 4,885,805 to Mason discloses apparel with carriers for neck-wear. U.S. Pat. No. 5,016,284 to Brown discloses lockable clothing. U.S. Pat. No. 5,325,542 to Lenerville discloses a decorative sock and method. Lastly, U.S. Pat. No. 5,734,993, to D'Oca discloses a hat and hat pin with sports logos.

While these devices fulfill their respective, particular objectives and requirements, the aforementioned patents do not describe a wearing apparel system with suspended indicia that allows suspending indicia of any one of a variety from an item of wearing apparel.

In this respect, the wearing apparel system with suspended indicia according to the present invention substantially departs from the conventional concepts and designs of the prior art, and in doing so provides an apparatus primarily developed for the purpose of suspending indicia of any one of a variety from an item of wearing apparel.

Therefore, it can be appreciated that there exists a continuing need for a new and improved wearing apparel system with suspended indicia which can be used for suspending indicia of any one of a variety from an item of wearing apparel. In this regard, the present invention substantially fulfills this need.

SUMMARY OF THE INVENTION

In view of the foregoing disadvantages inherent in the known types of wearing apparel, tags, indicia, etc. of known designs and configurations now present in the prior art, the present invention provides an improved wearing apparel system with suspended indicia. As such, the general purpose of the present invention, which will be described subsequently in greater detail, is to provide a new and improved wearing apparel system with suspended indicia and method which has all the advantages of the prior art and none of the disadvantages.

To attain this, the present invention essentially comprises a T-shirt with a torso portion. The torso portion is positionable around the torso of a wearer. The torso portion has a lower central opening for the waist of a wearer. The torso portion also has an upper central opening for the neck of a wearer. The torso portion also has upper side openings for the arms of a wearer. The torso portion is provided with a pair of circular holes there through. The holes are laterally spaced along a horizontal line between the lower opening and the upper opening, closer to the upper opening. The holes are located generally between the upper opening and one arm opening. The holes are laterally spaced by about 2 inches. Each hole has a diameter of about 3/16 inch. Each of the holes has strengthening members there around. The strengthening members are formed as overcast stitching in lines essentially radially extending from the center of each hole. The strengthening members function to improve wear resistance. Next provided is a flexible connector. The flexible connector has a length of about 8¼ inches. The connector has been formed of a plurality of hollow balls. Each of the balls has a diameter of about 5/32 inch. Two small apertures are provided through each ball extending in diametrically opposed relationship. The balls include two end balls and a plurality of intermediate balls. A dumbbell shaped member is located between each two adjacent intermediate balls. A dumbbell shaped member is also located between each end ball and its adjacent intermediate ball. The members have enlarged end sections located within adjacent balls. The members also have a reduced diameter central section. The central section of the dumbbell member extends through the apertures of adjacent balls to effect the flexible coupling between the balls of the connector. The connector also includes a coupling piece. The coupling piece is in a generally cylindrical configuration. The coupling piece has spaced axial slits along one axial edge. An enlarged opening between the slits allows the removable receipt of the end balls. In this manner the connector may be selectively formed into a loop with the connector extending through the apertures with the coupling piece located interior of the torso section of the T-shirt and with the flexible connector in three sections forming angles of about 60 degrees plus or minus 10 percent. A transparent holder is next provided. The holder is formed in a rectangular configuration. The holder has three closed edges. The holder also has a planar opening extending interiorly from an upper edge of the holder. A replaceable sign is provided. The replaceable sign is located within the opening. The holder also has a bore located above the opening. A loop of generally rigid metallic wire is provided. The loop extends around the connector exterior of the T-shirt and through the bore in the holder. In this manner coupling of the holder to the connector is effected.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved wearing apparel system with suspended indicia which has all of the advantages of the prior art wearing apparel, tags, indicia, etc. of known designs and configurations and none of the disadvantages.

It is another object of the present invention to provide a new and improved wearing apparel system with suspended indicia which may be easily and efficiently manufactured and marketed.

It is further object of the present invention to provide a new and improved wearing apparel system with suspended indicia which is of durable and reliable constructions.

An even further object of the present invention is to provide a new and improved wearing apparel system with suspended indicia which is susceptible of a low cost of manufacture with regard to both materials and labor, and which accordingly is then susceptible of low prices of sale to the consuming public, thereby making such wearing apparel system with suspended indicia economically available to the buying public.

Even still another object of the present invention is to provide a wearing apparel system with suspended indicia for suspending indicia of any one of a variety from an item of wearing apparel.

Lastly, it is an object of the present invention to provide a new and improved wearing apparel system including an item of wearing apparel having a torso portion with a pair of circular holes. The circular holes are laterally spaced along a horizontal line and have strengthening members around each hole. A flexible connector is formed of a plurality of hollow balls, including two end balls and a plurality of intermediate balls. Two small apertures extend through each ball in diametrically opposed relationship. A dumbbell shaped member is located between adjacent intermediate balls and between each end ball and its adjacent intermediate ball. The members include enlarged end sections located within adjacent balls and a reduced diameter central section extending through the apertures of adjacent balls. The connector also includes a coupling piece in a generally cylindrical configuration with spaced axial slits along one axial edge and an enlarged opening there between for the removable receipt of the end balls for allowing the connector to be selectively formed into a loop with the connector extending through the apertures with the coupling piece located interior of a portion of the wearing apparel. An object has means for coupling to the connector at a location diametrically opposed to the coupling piece exteriorly of the apparel.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a front elevational view of the new and improved wearing apparel system with suspended indicia constructed in accordance with the principles of the present invention.

FIG. 2 is an enlarged front elevational view of the suspended indicia shown in FIG. 1.

FIG. 3 is a top elevational view taken along line 3—3 of FIG. 2.

FIG. 4 is an exploded perspective view of the tag shown in FIGS. 1, 2 and 3.

The same reference numerals refer to the same parts throughout the various Figures.

DESCRIPTION OF THE PREFERRED EMBODIMENT

Figure 5:
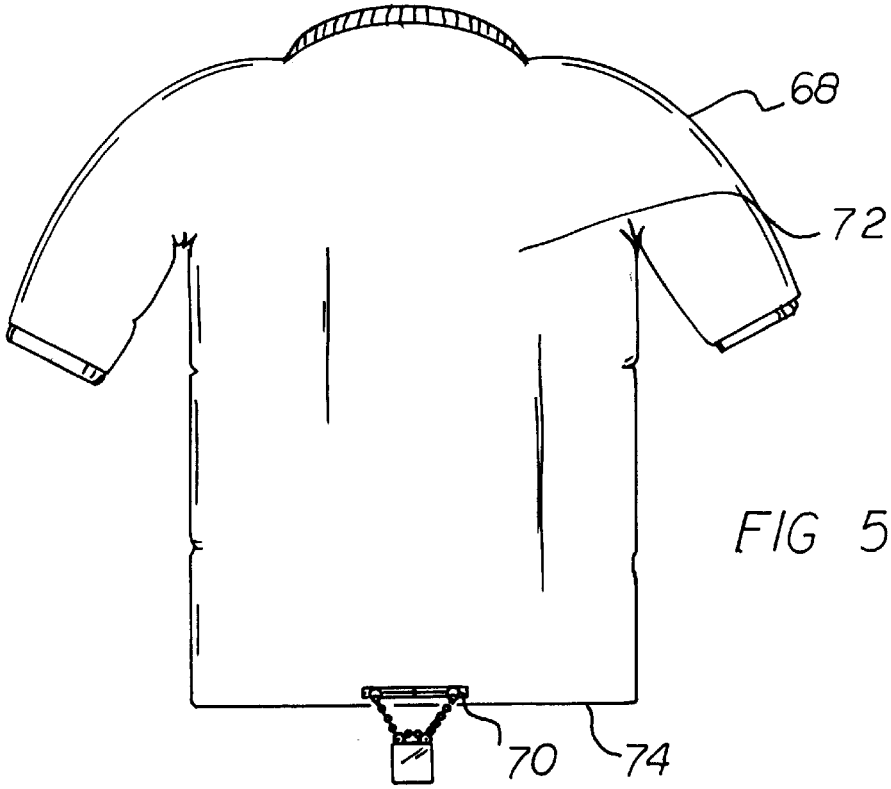
FIG. 5 is a rear elevational view of an alternate embodiment of the invention wherein the indicia is suspended from a lower portion at the rear of a shirt.

With reference now to the drawings, and in particular to FIG. 1 thereof, the preferred embodiment of the new and improved wearing apparel system with suspended indicia embodying the principles and concepts of the present invention and generally designated by the reference numeral 10 will be described.

The present invention, the wearing apparel system with suspended indicia 10 is comprised of a plurality of components. Such components in their broadest context include an item of wearing apparel, a a flexible connector, and an object with means to couple the object to the connector. Such components are individually configured and correlated with respect to each other so as to attain the desired objective.

First provided is a T-shirt 14. The T-shirt has a torso portion 16. The torso portion is positionable around the torso of a wearer. The torso portion has a lower central opening 18 for the waist of a wearer. The torso portion also has an upper central opening 20 for the neck of a wearer. The torso portion also has upper side openings 22 for the arms of a wearer. The torso portion is provided with a pair of circular holes 24 there through. The holes are laterally spaced along a horizontal line between the lower opening and the upper opening, closer to the upper opening. The holes are located generally between the upper opening and one arm opening. The holes are laterally spaced by about 2 inches. Each hole has a diameter of about 3/16 inch. Each of the holes has strengthening members there around. The strengthening members are formed as overcast stitching 26 in lines essentially radially extending from the center of each hole. The strengthening members function to improve wear resistance.

Next provided is a flexible connector 30. The flexible connector has a length of about 8¼ inches. The connector has been formed of a plurality of hollow balls 32. Each of the balls has a diameter of about 5/32 inch. Two small apertures are provided through each ball extending in diametrically opposed relationship. The balls include two end balls 34 and a plurality of intermediate balls 36. A dumbbell shaped member 38 is located between each two adjacent intermediate balls. A dumbbell shaped member is also located between each end ball and its adjacent intermediate ball. The members have enlarged end sections 40 located within adjacent balls. The members also have a reduced diameter central section 42. The central section of the dumbbell member extends through the apertures of adjacent balls to effect the flexible coupling between the balls of the connector. The connector also includes a coupling piece 46. The coupling piece is in a generally cylindrical configuration. The coupling piece has spaced axial slits 48 along one axial edge. An enlarged opening 50 between the slits allows the removable receipt of the end balls. In this manner the connector may be selectively formed into a loop with the connector extending through the apertures with the coupling piece located interior of the torso section of the T-shirt and with the flexible connector in three sections forming angles of about 60 degrees plus or minus 10 percent.

A transparent holder 52 is next provided. The holder is formed in a rectangular configuration. The holder has three closed edges 54. The holder also has a planar opening 56 extending interiorly from an upper edge of the holder. A replaceable sign 58 is provided. The replaceable sign is located within the opening. The holder also has a bore 60 located above the opening.

A loop 62 of generally rigid metallic wire is provided. The loop extends around the connector exterior of the T-shirt and through the bore in the holder. In this manner coupling of the holder to the connector is effected.

Figure 6:
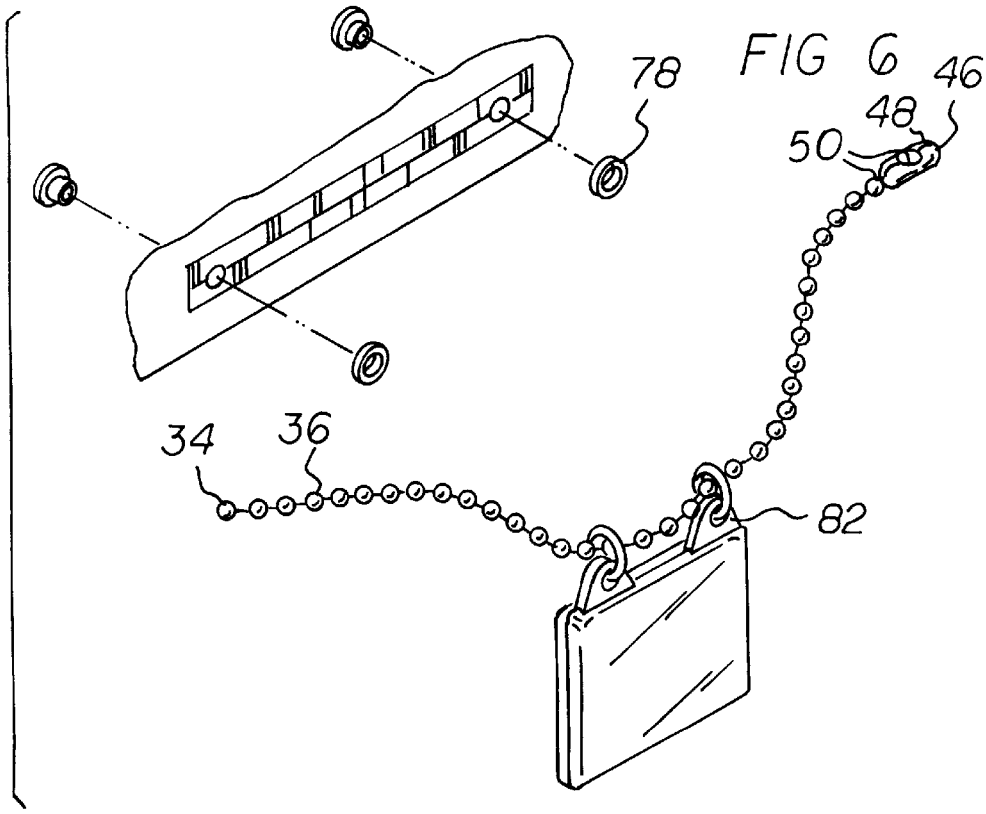
FIG. 6 is an exploded perspective view of the indicia related components of FIG. 5.

An alternate embodiment of the invention is shown in FIGS. 5 and 6. In Such embodiment, the item of wearing apparel is a shirt 68. The holes 70 in the shirt are located on the back 72, near the bottom 74. In this embodiment the strengthening members are grommets 78. The holder includes two bores 82 along an upper edge. The connected passes through the bores.

Figure 7:
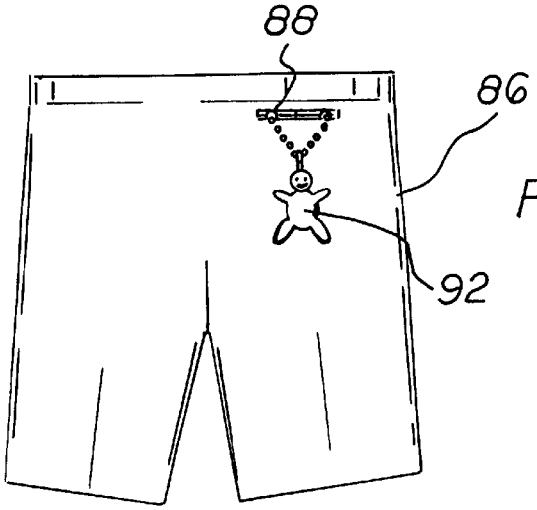
FIG. 7 is a rear elevational view of another alternate embodiment of the invention wherein the indicia is in the form of a toy suspended from the rear of trousers.
Figure 8:
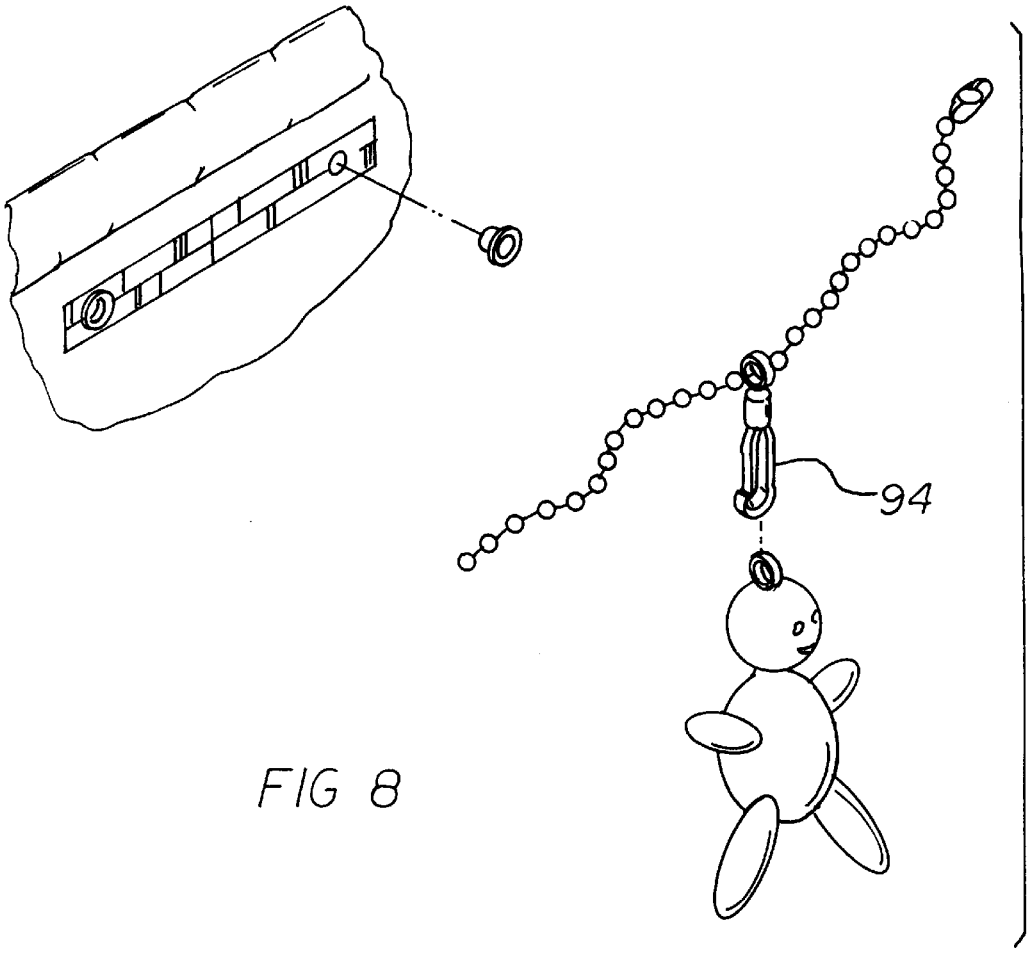
FIG. 8 is an exploded perspective view of the apertures and the toy and its chain separated from the apparel shown in FIG. 7.

In a final embodiment of the invention, shown in FIGS. 7 and 8, the item of wearing apparel is trousers 86. In this embodiment the holes 88 are located on the back of the trousers. In this embodiment the object is a toy 92. The toy is provided with a clip 94. The clip is releasably coupled between the toy and the connector.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved wearing apparel system with suspended indicia comprising, in combination:

a T-shirt having a torso portion positionable around the torso of a wearer with a lower central opening for the waist of a wearer and an upper central opening for the neck of a wearer and upper side openings for the arms of a wearer, the torso portion having a pair of circular holes there through, the holes being laterally spaced along a horizontal line between the lower opening and the upper opening, closer to the upper opening, and located generally between the upper opening and one arm opening, the holes being laterally spaced by about 2 inches with each hole having a diameter of about 3/16 inch, each of the holes having there around strengthening members formed as overcast stitching in lines essentially radially extending from the center of each hole for improved wear resistance;

a flexible connector with a length of about 8¼ inches, the connector being formed of a plurality of hollow balls, each of the balls having a diameter of about 5/32 inch with two small apertures extending through each ball in diametrically opposed relationship, the balls including two end balls and a plurality of intermediate balls, a dumbbell shaped member located between adjacent intermediate balls and between each end ball and its adjacent intermediate ball, the members including enlarged end sections located within adjacent balls and a reduced diameter central section extending through the apertures of adjacent balls to effect the flexible coupling between the balls of the connector, the connector also including a coupling piece in a generally cylindrical configuration with spaced axial slits along one axial edge and an enlarged opening there between for removable receipt of the end balls for allowing the connector to be selectively formed into a loop with the connector extending through the apertures with the coupling piece located interior of the torso section of the T-shirt and with the connecter in three sections forming angles of about 60 degrees plus or minus 10 percent;

a transparent holder in a rectangular configuration with three closed edges and a planar opening extending interiorly from an upper edge thereof and a replaceable sign located within the opening, the holder having a bore located above the opening; and a loop of generally rigid metallic wire extending around the connector exterior of the T-shirt and through the bore in the holder for coupling the holder to the connector.

2. A wearing apparel system with suspended indicia comprising:

an item of wearing apparel having a torso portion positionable around a portion of a wearer with a pair of circular holes there through, the holes being laterally spaced along a horizontal line, the holes having a diameter and, strengthening members around each hole for improved wear resistance;

a flexible connector, the connector being formed of a plurality of hollow balls, each of the balls having two small apertures extending through each ball in diametrically opposed relationship, the balls including two end balls and a plurality of intermediate balls, a dumbbell shaped member located between adjacent intermediate balls and between each end ball and its adjacent intermediate ball, the members including enlarged end sections located within adjacent balls and a reduced diameter central section extending through the apertures of adjacent balls to effect the flexible coupling between the balls of the connector, the connector also including a coupling piece in a generally cylindrical configuration with spaced axial slits along one axial edge and an enlarged opening connector there between for the removable receipt of the end balls for allowing the connector to be selectively formed into a loop with the connector extending through the apertures with the coupling piece located interior of a portion of the wearing apparel; and an object with means to couple the object to the connector at a location diametrically opposed to the coupling piece exteriorly of the apparel.

3. The system as set forth in claim 2 wherein the item of wearing apparel is a shirt with the holes being located on the back near the bottom thereof.

4. The system as set forth in claim 2 wherein the strengthening members are grommets.

5. The system as set forth in claim 2 wherein the object includes two bores along an upper edge for passage of the connector there through.

6. The system as set forth in claim 2 wherein the item of wearing apparel is trousers with the holes being located on the back thereof.

7. The system as set forth in claim 2 wherein the object is a toy with a clip releaseably coupled between the toy and the connector.

* * * * *